US008865388B2

(12) United States Patent
Aoki et al.

(10) Patent No.: US 8,865,388 B2
(45) Date of Patent: Oct. 21, 2014

(54) ELECTROPHOTOGRAPHIC TONER AND PROCESS FOR PRODUCING ELECTROPHOTOGRAPHIC TONER

(71) Applicant: Toshiba Tec Kabushiki Kaisha, Tokyo (JP)

(72) Inventors: Takayasu Aoki, Shizuoka-ken (JP); Takahito Kabai, Shizuoka-ken (JP); Tsuyoshi Itou, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/134,359

(22) Filed: Dec. 19, 2013

(65) Prior Publication Data

US 2014/0106277 A1 Apr. 17, 2014

Related U.S. Application Data

(62) Division of application No. 12/782,178, filed on May 18, 2010, now Pat. No. 8,637,217.

(60) Provisional application No. 61/181,430, filed on May 27, 2009.

(51) Int. Cl.

| | |
|---|---|
| ***G03G 5/00*** | (2006.01) |
| ***G03G 9/08*** | (2006.01) |
| ***G03G 9/09*** | (2006.01) |
| ***G03G 9/087*** | (2006.01) |

(52) U.S. Cl.

CPC ..... *G03G 9/0808* (2013.01); *G03G 9/081* (2013.01); *G03G 9/0926* (2013.01); *G03G 9/0906* (2013.01); *G03G 9/0924* (2013.01); *G03G 9/0928* (2013.01); *G03G 9/08782* (2013.01)

USPC ..... 430/137.21; 430/123.57; 430/137.1

(58) Field of Classification Search

CPC ..... G03G 9/0808; G03G 9/0801; G03G 9/08782; G03G 9/0906; G03G 9/0926; G03G 9/0928

USPC ..... 430/137.21, 123.57, 137.1

See application file for complete search history.

(56) References Cited

U.S. PATENT DOCUMENTS

| | | | |
|---|---|---|---|
| 6,313,066 | B1 | 11/2001 | Takayama |
| 6,528,222 | B2 | 3/2003 | Kohtaki et al. |
| 7,378,373 | B2 | 5/2008 | Gotanda et al. |
| 2006/0111237 | A1 | 5/2006 | Takayama et al. |
| 2007/0072773 | A1 | 3/2007 | Takayama et al. |

FOREIGN PATENT DOCUMENTS

| | | |
|---|---|---|
| EP | 1 041 448 | 10/2000 |
| EP | 1 557 282 | 7/2005 |
| EP | 1 582 373 | 10/2005 |

(Continued)

OTHER PUBLICATIONS

Extended European Search Report for European Application No. 10163535.7 mailed on Apr. 1, 2011.

Translation of First Notification of Examiner's Opinion for Chinese Application No. 201010188551.7 dated May 15, 2012, 6 pgs.

(Continued)

*Primary Examiner* — Thorl Chea

(74) *Attorney, Agent, or Firm* — Amin, Turocy & Watson, LLP

(57) ABSTRACT

Disclosed is an decolorizable electrophotographic toner, containing a binder resin, an electron-donating color-developable agent, and a wax having a color-developing action and having an acid value of 60 mgKOH/g or more.

5 Claims, 2 Drawing Sheets

(56) References Cited

FOREIGN PATENT DOCUMENTS

| | | |
|---|---|---|
| JP | 2000019770 | 1/2000 |
| JP | 2003-195554 | 7/2003 |
| JP | 2003-195555 | 7/2003 |
| JP | 2004315735 | 11/2004 |

OTHER PUBLICATIONS

Translation of Second Notification of Examiner's Opinion for Chinese Application No. 201010188551.7 dated Aug. 21, 2012, 6 pgs.
U.S. Office Action mailed Nov. 19, 2012 corresponding to U.S. Appl. No. 12/782,178, filed May 18, 2010.
U.S. Office Action mailed May 8, 2013 corresponding to U.S. Appl. No. 12/782,178, filed May 18, 2010.

FIG. 2

| | Example 1 | Example 2 | Example 3 | Example 4 | Example 5 | Example 6 | Example 7 | Comparative example 1 | Comparative example 2 | Comparative example 3 | Comparative example 4 |
|---|---|---|---|---|---|---|---|---|---|---|---|
| First wax | MP-WAX J-546 | MP-WAX J-546 | Ceramer 1608 | Ceramer 1608 | Ceramer 1608 | MP-WAX J-546 | Ceramer 1608 | Rice wax | Licowax KPS flakes | Carnauba wax | Ceramer 67 |
| Second wax | – | Carnauba wax | – | Hi-WAX 220MP | Licowax KPS flakes | – | Hi-WAX 4052E | | | | |
| Ratio of amount of color-developable agent to first wax | 1:5 | 1:5 | 1:3 | 1:2 | 1:3 | 1:10 | 1:3 | 1:5 | 1:5 | 1:5 | 1:5 |
| Ratio of amount of first wax to second wax | – | 1:1 | – | 1:1 | 1:1.67 | – | 1:1.67 | | | | |
| Image density (before decolorizing treatment) | 0.45 | 0.35 | 0.51 | 0.42 | 0.45 | 0.47 | 0.53 | Color was not developed. | Color was not developed. | Color was not developed. | Color was not developed. |
| Image density (after decoloring treatment) | 0.15 | 0.07 | 0.19 | 0.12 | 0.17 | 0.18 | 0.10 | – | – | – | – |

ELECTROPHOTOGRAPHIC TONER AND PROCESS FOR PRODUCING ELECTROPHOTOGRAPHIC TONER

CROSS-REFERENCE TO RELATED APPLICATIONS

This application is a Division of application Ser. No. 12/782,178 filed on May 18, 2010, the entire contents of which are incorporated herein by reference.

This application is based upon and claims the benefit of priority from: US provisional application 61/181, 430, filed on May 27, 2009, the entire contents of which are incorporated herein by reference.

TECHNICAL FIELD

The present invention relates to an electrophotographic toner and relates to an image forming technique in which an image formed on a recording medium by an electrophotographic process, an electrostatic printing process, or the like can be decolorized.

BACKGROUND

At present, digitization of information is proceeding, however, a state of being displayed on a display is not suitable for reading through the entire information. Therefore, although digitization is proceeding, the amount of consumption of a recording medium (paper) is increasing. Further, in order to suppress $CO_2$ emission, it is demanded to suppress the amount of consumption of paper.

Therefore, a technique capable of recycling paper by decolorizing an image from the paper having the image formed thereon is proposed.

For example, a technique in which a plurality of reversible thermal color-developable compositions having different coloring tones and different decolorization starting temperatures are allowed to exist in paper in a state where the compositions are independently encapsulated in separate microcapsules is proposed (JP-A-2004-42635). However, the technique proposed in JP-A-2004-42635 relates to special paper in which the thermal color-developable compositions are allowed to exist, and is not a technique in which an image formed on common paper is decolorized.

Further, a pigment comprising: a composition which contains an electron-donating color-developable agent, an electron-accepting color-developing agent, a reaction medium for determining a color-developing reaction starting temperature, and a predetermined color-changing temperature regulating agent as four essential components, and reversibly changes its color according to the temperature change; and microcapsules encapsulating the composition is proposed (JP-A-2004-315735). However, the technique proposed in JP-A-2004-315735 assumes the use thereof in an ink, and therefore, the color-changing temperature is low. Further, since the four essential components are encapsulated in microcapsules, and therefore, the structure thereof is complicated.

Further, as a technique for producing an decolorizable toner, a technique in which all the ingredients are mixed and a first kneading operation is performed, and the resulting kneaded material is coarsely pulverized, and then, a second kneading operation is performed is proposed (JP-A-2000-19770). However, in the technique proposed in JP-A-2000-19770, a plurality of components such as a color-developable agent, a color-developing agent, and a decolorizing agent are handled in a solid phase, and therefore, color developing and decolorizing reactions are not prompt or sufficient.

SUMMARY

In order to solve the above problems, this specification relates to an decolorizable electrophotographic toner containing a binder resin, an electron-donating color-developable agent, and a wax having a color-developing action and having an acid value of 60 mgKOH/g or more.

This specification also relates to a process for producing an decolorizable electrophotographic toner including: mixing an electron-donating color-developable agent with a wax having a color-developing action and having an acid value of 60 mgKOH/g or more, and heat-melting the resulting mixture, thereby allowing the electron-donating color-developable agent to develop a color; and mixing a binder resin with the mixture of the electron-donating color-developable agent in a color-developed state and the wax having a color-developing action.

DESCRIPTION OF THE DRAWINGS

FIG. 2 is a table showing structures of Examples according to an embodiment and Comparative examples, and image densities obtained when image formation was performed using toners of the Examples.

DETAILED DESCRIPTION

Figure 1:
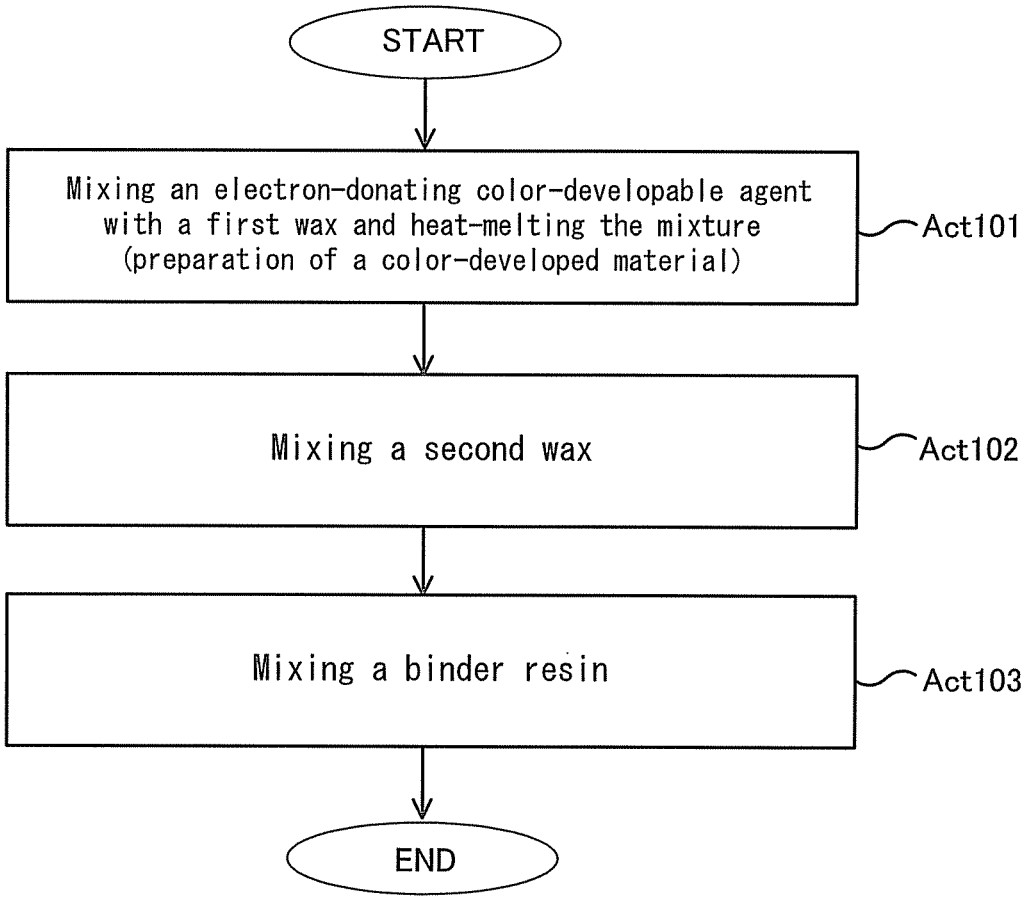
FIG. 1 is a flowchart according to one example of a process for producing an electrophotographic toner of an embodiment.

Hereinafter, an embodiment will be described with reference to the drawings.

An electrophotographic toner of this embodiment (hereinafter simply referred to as "toner") is capable of decolorizing an image output on paper by an electrophotographic process, an electrostatic printing process, or the like using the toner, and contains a binder resin, an electron-donating color-developable agent, and a wax having a color-developing action and having an acid value of 60 mgKOH/g or more. Incidentally, in this embodiment, the wax having a color-developing action is referred to as "first wax".

The binder resin constituting the toner of this embodiment is not particularly limited, and can be suitably selected by a person skilled in the art. As the binder resin, for example, a polyester resin obtained by subjecting a dicarboxylic acid component and a diol component to an esterification reaction followed by a polycondensation reaction, and a polystyrene resin can be used.

Among these components, examples of the dicarboxylic acid component include aromatic dicarboxylic acids such as terephthalic acid, phthalic acid, and isophthalic acid; and aliphatic dicarboxylic acids such as fumaric acid, maleic acid, succinic acid, adipic acid, sebacic acid, glutaric acid, pimelic acid, oxalic acid, malonic acid, citraconic acid, and itaconic acid.

Further, examples of the diol component include aliphatic diols such as ethylene glycol, propylene glycol, 1,4-butanediol, 1,3-butanediol, 1,5-pentanediol, 1,6-hexanediol, neopentyl glycol, trimethylene glycol, trimethylolpropane, and pentaerythritol; alicyclic diols such as 1,4-cyclohexanediol and 1,4-cyclohexanedimethanol; and an ethylene oxide or propylene oxide adduct of bisphenol A or the like.

Further, the above polyester component may be converted so as to have a crosslinking structure using a trivalent or higher polyvalent carboxylic acid component or a trihydric or higher polyhydric alcohol component such as 1,2,4-benzenetricarboxylic acid (trimellitic acid) or glycerin.

In the toner of this embodiment, two or more kinds of polyester resins having different compositions may be mixed and used.

Further, in the toner of this embodiment, the polyester resin may be crystalline or noncrystalline.

Further, as the polystyrene resin, a polystyrene resin obtained by copolymerization of an aromatic vinyl component and a (meth)acrylic acid ester component is preferred. Examples of the aromatic vinyl component include styrene, α-methylstyrene, o-methylstyrene, and p-chlorostyrene. Examples of the acrylic acid ester component include ethyl acrylate, propyl acrylate, butyl acrylate, 2-ethylhexyl acrylate, butyl methacrylate, ethyl methacrylate, and methyl methacrylate. Among these, butyl acrylate is generally used. As the polymerization method, an emulsion polymerization method is generally employed, and the resin is obtained by radical polymerization of monomers of the respective components in an aqueous phase containing an emulsifier.

The glass transition temperatures of the polyester resin and the polystyrene resin are preferably 45° C. or higher and 70° C. or lower, and more preferably 50° C. or higher and 65° C. or lower. If the glass transition temperature is lower than 45° C., the heat-resistant storage stability of the toner is deteriorated as compared with the case where the glass transition temperature is in the above range. On the other hand, if the glass transition temperature is higher than 70° C., the low-temperature fixability is deteriorated as compared with the case where the glass transition temperature is in the above range, and further, it becomes difficult to decolorize an image when an decolorizing treatment by heating is performed as compared with the case where the glass transition temperature is in the above range.

The weight average molecular weight Mw of the polyester resin is preferably 5000 or more and 30000 or less. On the other hand, the weight average molecular weight Mw of the polystyrene resin is preferably 10000 or more and 70000 or less. If the weight average molecular weight Mw of the polyester resin is less than 5000 (in the case of the polystyrene resin, less than 10000), the heat-resistant storage stability of the toner is deteriorated as compared with the case where the weight average molecular weight Mw is in the above range. Further, if the weight average molecular weight Mw of the polyester resin is more than 30000 (in the case of the polystyrene resin, more than 70000), the fixing temperature is increased as compared with the case where the weight average molecular weight Mw is in the above range, and therefore, it is not preferred from the viewpoint of suppressing power consumption in a fixing treatment.

Subsequently, the electron-donating color-developable agent in the toner according to this embodiment will be described. As the electron-donating color-developable agent, for example, a leuco dye can be used. Examples of the leuco dye include diphenylmethane phthalides, phenylindolyl phthalides, indolyl phthalides, diphenylmethane azaphthalides, phenylindolyl azaphthalides, fluorans, styrynoquinolines, and diaza-Rhodamine lactones.

Specific examples thereof include 3,3-bis(p-dimethylaminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino)fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino)fluoran, 1,2-benz-6-(N-ethyl-N-isoamylamino)fluoran, 2-(3-methoxy-4-dodecoxystyryl)quinoline, spiro[5H-(1)benzopyrano(2,3-d)pyrimidine-5,1'(3'H)isobenzofuran]-3'-one, 2-(diethylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-methyl-, spiro[5H-(1)benzopyrano(2,3-d)pyrimidine-5,1'(3'H)isobenzofuran]-3'-one, 2-(di-n-butylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(N-ethyl-N-i-amylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-phenyl, 3-(2-methoxy-4-dimethylaminophenyl)-3-(1-butyl-2-methylindol -3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, and 3-(2-ethoxy-4-diethylaminophenyl)-3-(1-pentyl-2-methylindol-3-yl)-4,5,6,7-tetrachlorophthalide. Additional examples thereof include pyridine compounds, quinazoline compounds, and bisquinazoline compounds. Two or more of these compounds may be mixed and used.

Subsequently, the first wax in the toner according to this embodiment will be described. The lower limit of the acid value (AV) of the first wax is 60 mgKOH/g. If the acid value thereof is 60 mgKOH/g or more, the first wax can react with the electron-donating color-developable agent and develop a color. That is, in this embodiment, the first wax has an action as a release agent for preventing offset and the like, and also functions as a color-developing agent that reacts with a color-developable agent to develop a color.

Incidentally, the acid value of the first wax can be measured according to JIS K 2501-2003 Petroleum Products and Lubricants-Test Method for Neutralization Number or the like on the basis of the amount of potassium hydroxide required for neutralizing all the acidic components contained in the wax. Further, the acid value of a second wax described later can also be measured according to the same method.

The first wax is not particularly limited, however, those having an ester bond of a component composed of an alcohol component and a carboxylic acid component are preferred. Examples of the alcohol component include higher alcohols, and examples of the carboxylic acid component include saturated fatty acids having a linear alkyl group, unsaturated fatty acids such as monoenic acid and polyenic acid, and hydroxy fatty acids. Further examples of the carboxylic acid component include unsaturated polyvalent carboxylic acids such as maleic acid, fumaric acid, citraconic acid, and itaconic acid. Further, anhydrides thereof may be used.

Among the above-mentioned carboxylic acid components, unsaturated polyvalent carboxylic acid components and anhydrides thereof are particularly preferred.

As the first wax, specifically, among aliphatic hydrocarbon waxes such as a low molecular weight polyethylene, a low molecular weight polypropylene, a polyolefin copolymer, polyolefin wax, paraffin wax, and Fischer-Tropsch wax and modifications thereof; vegetable waxes such as candelilla wax, carnauba wax, Japan wax, jojoba wax, and rice wax; animal waxes such as bees wax, lanolin, and whale wax; mineral waxes such as montan wax, ozokerite, and ceresin; fatty acid amides such as linoleic acid amide, oleic acid amide, and lauric acid amide; functional synthetic waxes; and silicone-based waxes, those having an acid value of 60 mgKOH/g or more can be exemplified. For example, a maleic anhydride-modified wax can be used.

Further, in this embodiment, the upper limit of the acid value (AV) of the first wax is preferably 160 mgKOH/g. If the acid value thereof is more than 160 mgKOH/g, a time required for decolorizing an image becomes longer than the case where the acid value is in the above range.

Further, in the toner of this embodiment, the first wax is preferably contained in an amount of from 1 to 10 parts by mass, more preferably from 1 to 5 parts by mass based on 1 part by mass of the electron-donating color-developable agent. Even if the amount of the first wax is made less than 1 part by mass or made more than 10 parts by mass, the developed color density of the formed image does not vary so much. On the other hand, if the amount of the first wax is less than 1 part by mass, the amount of the electron-donating color-developable agent, which is generally expensive, increases, leading to an increase in the cost. Further, if the amount of the first wax is more than 10 parts by mass, it becomes difficult to decolorize a color as compared with the case where the amount thereof is in the above range.

Still further, in the toner of this embodiment, in addition to the above-mentioned binder resin, electron-donating color-developable agent, and first wax, a wax having a higher melting point than the first wax and having an acid value of 20 mgKOH/g or less (hereinafter simply referred to as "second wax") may be incorporated. By incorporating the second wax, an image can be more promptly decolorized by an decolorizing treatment as compared with the case where the second wax is not incorporated. That is, the second wax can be considered to be a wax having a decolorization accelerating action. The reason why an image can be promptly decolorized by incorporating the second wax is not exactly known. However, it is considered that the compatibility between the first wax and the second wax is increased by heating at the time of an decolorizing treatment, and as a result, the first wax is separated from the color-developable agent, thereby accelerating decolorization.

When the second wax is incorporated, the second wax is preferably contained in an amount of from 1 to 2 parts by mass based on 1 part by mass of the first wax. If the amount of the second wax is less than 1 part by mass, the action of decolorizing an image is reduced as compared with the case where the amount thereof is in the above range. Further, if the amount thereof is more than 2 parts by mass, due to the dilution effect of the wax itself, the image density of the formed image decreases as compared with the case where the amount thereof is in the above range.

Incidentally, the first wax and the second wax preferably have a softening point (melting point) in the range of from 50° C. to 120° C., more preferably from 60° C. to 110° C. from the viewpoint of low-temperature fixability. Further, as described above, the melting point of the second wax is higher than that of the first wax.

Further, the lower limit of the acid value of the second wax is not particularly limited, however, for example, a commercially available wax having an acid value of 1 mgKOH/g or the like can be used.

The second wax is not particularly limited, however, those showing compatibility with the first wax are preferred. Further, in the same manner as the first wax, those having an ester bond of a component composed of an alcohol component and a carboxylic acid component are preferred. Examples of the alcohol component include higher alcohols, and examples of the carboxylic acid component include saturated fatty acids having a linear alkyl group, unsaturated fatty acids such as monoenic acid and polyenic acid, and hydroxy fatty acids. Further examples of the carboxylic acid component include unsaturated polyvalent carboxylic acids such as maleic acid, fumaric acid, citraconic acid, and itaconic acid. Further, anhydrides thereof may be used.

Among the above-mentioned carboxylic acid components, unsaturated polyvalent carboxylic acid components and anhydrides thereof are particularly preferred.

As the second wax, specifically, among aliphatic hydrocarbon waxes such as a low molecular weight polyethylene, a low molecular weight polypropylene, a polyolefin copolymer, polyolefin wax, paraffin wax, and Fischer-Tropsch wax and modifications thereof; vegetable waxes such as candelilla wax, carnauba wax, Japan wax, jojoba wax, and rice wax; animal waxes such as bees wax, lanolin, and whale wax; mineral waxes such as montan wax, ozokerite, and ceresin; fatty acid amides such as linoleic acid amide, oleic acid amide, and lauric acid amide; functional synthetic waxes; and silicone based waxes, those having an acid value of 20 mgKOH/g or less can be exemplified.

Further, in the toner of this embodiment, other components such as a color-developing agent, a charge control agent, and an external additive may be contained.

As the color-developing agent, specifically, an electron-accepting color-developing agent which donates a proton to the electron-donating color-developable agent can be used. Examples thereof include phenols, metal salts of phenols, metal salts of carboxylic acids, aromatic carboxylic acids, aliphatic carboxylic acids having 2 to 5 carbon atoms, benzophenones, sulfonic acids, sulfonates, phosphoric acids, metal salts of phosphoric acids, acidic phosphoric acid esters, metal salts of acidic phosphoric acid esters, phosphorous acids, metal salts of phosphorous acids, monophenols, polyphenols, 1,2,3-triazole, and derivatives thereof.

As the charge control agent, a metal-containing azo compound is used, and the metal element is preferably a complex or a complex salt of iron, cobalt, or chromium or a mixture thereof. Further, a metal-containing salicylic acid derivative compound can also be used as the charge control agent. In the case of using a metal-containing salicylic acid derivative compound, the metal element is preferably a complex or a complex salt of zirconium, zinc, chromium, or boron, or a mixture thereof. By incorporating the charge control agent, a frictional charge quantity can be controlled.

Further, an external additive may be contained. For example, in order to adjust the fluidity or chargeability, inorganic fine particles can be externally added and mixed in an amount of from 0.01 to 20% by mass based on the total weight of the toner particles. As such inorganic fine particles, silica, titania, alumina, strontium titanate, tin oxide, and the like can be used alone or by mixing two or more of them. It is preferred that as the inorganic fine particles, those surface-treated with a hydrophobizing agent are used from the viewpoint of improvement of environmental stability. Further, other than such inorganic oxides, resin fine particles having a particle size of 1 μm or less may be externally added for improving the cleaning property.

The process for producing a toner of this embodiment is not particularly limited, and can be suitably selected by a person skilled in the art. For example, the toner can be produced by a mechanical production process such as a melt-kneading pulverization method or a so-called chemical production process in which a toner is produced using a binder resin dispersion liquid, or the like.

Among these, in the case of using a mechanical production process such as a melt-kneading pulverization method, in a production step, heating under conditions similar to those for an decolorizing treatment may be sometimes performed. Therefore, the developed color density of the toner may be sometimes decreased, and thus, the toner is preferably produced by a chemical production process.

With reference to FIG. 1, one example of the process for producing a toner of this embodiment will be described by illustrating the case where the second wax is contained in the toner.

First, in Act 101, an electron-donating color-developable agent and a first wax are mixed, followed by heat-melting, whereby a mixture in which the color-developable agent is in a color-developed state (hereinafter referred to as "color-developed material") is obtained. The conditions such as a temperature and a heating time at the time of heat-melting are not particularly limited, and can be suitably determined according to a color-developable agent and a wax to be used, a desired developed color density of a toner, and the like. For example, when the developed color density is desired to be increased, the heating is stopped immediately after the color is developed.

Subsequently, after cooling, in Act 102, a second wax is mixed with the color-developed material.

Thereafter, in Act 103, the color-developed material in which the second wax is mixed is mixed with a binder resin, whereby a toner is produced. For example, in the case of using a melt-kneading pulverization method, a pulverized color-developed material is melt-mixed with a binder resin, followed by pulverization and classification, whereby a toner is produced. Alternatively, for example, in the case of using an emulsion aggregation method, a pulverized color-developed material and a binder resin are melt-mixed, and the resulting mixture is emulsified by a known method. Subsequently, the resulting emulsion is subjected to aggregation and polymerization, whereby a toner is produced.

Here, as described above, the production of a toner of this embodiment is preferably performed as follows. An electron-donating color-developable agent and a first wax are mixed, and the resulting mixture is heat-melted, whereby the electron-donating color-developable agent is allowed to develop a color, and a binder resin is mixed with the mixture of the electron-donating color-developable agent in a color-developed state and the first wax. By allowing the electron-donating color-developable agent to develop a color in advance by mixing it with the first wax, followed by heat-melting, the color developability can be further enhanced and the image density can be increased.

Incidentally, as described above, other components may be mixed with the color-developed material and the binder resin, and further, an external additive may be externally added thereto.

Further, in the flowchart shown in FIG. 1, after the color-developed material is prepared, the second wax is mixed with the color-developed material. However, it is also possible to develop a color by performing heat-melting after the second wax is mixed with the first wax and the electron-donating color-developable agent.

The thus produced toner is placed in, for example, a toner cartridge, and the toner cartridge is mounted on an image forming apparatus such as MFP (Multi Function Peripheral), and the toner can be used for forming an image by an electrophotographic process.

Further, the image formed using the toner of this embodiment can be decolorized from the paper by, for example, a heating treatment. The electron-donating color-developable agent such as a leuco dye typified by CVL (crystal violet lactone) is relatively easily decomposed by heat, and the color thereof is decolorized by heating at a temperature not lower than the decomposable temperature thereof for, for example, about 30 minutes to 2 hours, and the color is not redeveloped. Further, when the toner contains the second wax, the decolorizing treatment can be more promptly performed. In this case, heating is preferably performed at a temperature not lower than the melting point of the second wax.

EXAMPLES

Subsequently, the toner of this embodiment will be described in more detail with reference to Examples. However, the invention is by no means limited to the following Examples.

Example 1

As the electron-donating color-developable agent, 0.1 g of CVL (crystal violet lactone) which is a leuco dye and is manufactured by Hodogaya Chemical Co., Ltd. was used. Further, as the first wax, 0.5 g of MP-WAX J-546 (acid value: 75 mgKOH/g) manufactured by Chukyo Yushi Co., Ltd. was used.

First, CVL and MP-WAX J-546 were melt-mixed by heating to 160° C., and the resulting mixture was cooled, whereby a color-developed material which developed a blue color was obtained. The heating was stopped and the mixture was cooled immediately after the color was developed, the color-developed material was pulverized with a ball mill. 10 parts of the pulverized color-developed material and 90 parts of a polyester binder resin (melting point: 105° C.) were melt-mixed, and the resulting mixture was emulsified by a known mechanical pulverization method. The resulting emulsion liquid was subjected to aggregation with $Al_2(SO_4)_3$, and the temperature of the liquid was raised to 90° C., whereby a slurry liquid containing toner particles having a volume average particle diameter of 9.5 μm was obtained. Then, the resulting slurry liquid was washed and dried, and thereafter, $SiO_2$ and $TiO_2$ were externally added thereto, whereby a toner was produced.

Example 2

A toner was produced in the same manner as in Example 1 except that 0.5 g of carnauba wax (acid value: 3.5 mgKOH/g) manufactured by S. Kato & Co. was mixed as the second wax with a color-developed material obtained in the same manner as in Example 1 using 0.1 g of CVL and 0.5 g of MP-WAX J-546.

Example 3

A toner was produced in the same manner as in Example 1 except that 0.3 g of Ceramer 1608 (acid value: 154 mgKOH/g) manufactured by Baker Petrolite Corporation was used as the first wax in place of MP-WAX J-546.

Example 4

A toner was produced in the same manner as in Example 2 except that 0.2 g of Ceramer 1608 (acid value: 154 mgKOH/ g) was used as the first wax in place of MP-WAX J-546, and 0.4 g of Hi-WAX 220MP (acid value: 1.0 mgKOH/g) manufactured by Mitsui Chemicals, Inc. was used as the second wax in place of carnauba wax.

Example 5

A toner was produced in the same manner as in Example 2 except that 0.3 g of Ceramer 1608 (acid value: 154 mgKOH/g) was used as the first wax in place of MP-WAX J-546, and 0.5 g of Licowax KPS flakes (acid value: 35 mgKOH/g) manufactured by Clariant was used as the second wax in place of carnauba wax.

Example 6

A toner was produced in the same manner as in Example 1 except that 1.0 g of MP-WAX J-546 (acid value: 75 mgKOH/g) was used as the first wax.

Example 7

A toner was produced in the same manner as in Example 2 except that 0.3 g of Ceramer 1608 (acid value: 154 mgKOH/g) was used as the first wax in place of MP-WAX J-546, and 0.5 g of Hi-WAX 4052E (acid value: 20 mgKOH/g) manufactured by Mitsui Chemicals, Inc. was used as the second wax in place of carnauba wax.

Comparative Example 1

0.1 g of CVL and 0.5 g of rice wax (acid value: 5 mgKOH/g) were melt-mixed by heating to 160° C., however, a color-developed material could not be obtained.

Comparative Example 2

0.1 g of CVL and 0.5 g of Licowax KPS flakes (acid value: 35 mgKOH/g) were melt-mixed by heating to 160° C., however, a color-developed material could not be obtained.

Comparative Example 3

0.1 g of CVL and 0.5 g of carnauba wax (acid value: 3.5 mgKOH/g) were melt-mixed by heating to 160° C., however, a color-developed material could not be obtained.

Comparative Example 4

0.1 g of CVL and 0.5 g of Ceramer 67 (acid value: 48 mgKOH/g) manufactured by Baker Petrolite Corporation were melt-mixed by heating to 160° C., however, a color-developed material could not be obtained.

Printing was performed by an electrophotographic process using each of the toners of Example 1 to 7, and sheets of paper on which a solid image was output were obtained. Subsequently, an image density was measured with a Macbeth densitometer (manufactured by Gretag Macbeth, using a blue filter).

Then, the paper medium on which the image was output using each of the toners of Examples 1 to 7 was placed on a hot plate, and heated at 120° C. for 30 minutes (decolorizing treatment). Thereafter, an image density was measured for each paper medium. The results are shown in FIG. 2.

Incidentally, in FIG. 2, for the sake of easy understanding of the correlation, the wax used in each of the Comparative examples is shown as the first wax.

In the case of each of the toners of Examples 1 to 7, although a color-developing agent was not contained as a constituent, the color-developable agent could be allowed to develop a color and an image having a sufficient image density as shown in FIG. 2 could be printed. Further, by the decolorizing treatment, the image density of the image printed using each of the toners of Examples was decreased in all the cases, and the image could be decolorized. In particular, in the case of the toners of Examples 2, 4, and 7 containing the second wax, a high decolorizing performance was exhibited although the decolorizing treatment was performed for as short as 30 minutes.

The invention can be implemented in other various forms without departing from the spirit or major features of the invention. Therefore, the above embodiments are simply given for exemplary purpose in every respect and should not be interpreted as limitative. The scope of the invention is defined by the claims attached hereto and is in no way bound by the description in the specification. Further, all the variations, various improvements, substitutes, and modifications belonging to the equivalent range of the scope of the claims are all within the scope of the invention.

As described in detail above, according to the above embodiments, a technique capable of realizing an decolorizable electrophotographic toner having a simpler structure than the related art can be provided.

What is claimed is:

1. A process for producing an decolorizable electrophotographic toner, comprising:

mixing an electron-donating color-developable agent with a wax having a color-developing action and having an acid value of 60 mgKOH/g or more, and heat-melting the resulting mixture, thereby allowing the electron-donating color-developable agent to develop a color; and mixing a binder resin with the mixture of the electron-donating color-developable agent in a color-developed state and the wax having a color-developing action.

2. The process according to claim 1, wherein the wax having a color-developing action has an acid value of 160 mgKOH/g or less.

3. The process according to claim 1, wherein the wax having a color-developing action is mixed in an amount of from 1 to 10 parts by mass based on 1 part by mass of the electron-donating color-developable agent.

4. The process according to claim 1, further comprising mixing a wax having a decolorization accelerating action and having a higher melting point than the wax having a color-developing action and an acid value of 20 mgKOH/g or less with the electron-donating color-developable agent and the wax having a color-developing action.

5. The process according to claim 1, wherein the wax having a decolorization accelerating action is mixed in an amount of from 1 to 2 parts by mass based on 1 part by mass of the wax having a color-developing action.

* * * * *